US007925421B2

(12) United States Patent
Liu et al.

(10) Patent No.: US 7,925,421 B2
(45) Date of Patent: Apr. 12, 2011

(54) OFF-LINE CALIBRATION OF UNIVERSAL TRACKING AIR FUEL RATIO REGULATORS

(75) Inventors: Sharon Liu, Ann Arbor, MI (US); Kenneth P. Dudek, Rochester Hills, MI (US); Sai Rajagopalan, Columbus, OH (US); Stephen Yurkovich, Columbus, OH (US); Yiran Hu, Powell, OH (US); Yann G. Guezennec, Upper Arlington, OH (US); Shawn W. Midlam-Mohler, Columbus, OH (US)

(73) Assignee: GM Global Technology Operations LLC

( * ) Notice: Subject to any disclaimer, the term of this patent is extended or adjusted under 35 U.S.C. 154(b) by 349 days.

(21) Appl. No.: 12/260,334

(22) Filed: Oct. 29, 2008

(65) Prior Publication Data

US 2009/0271093 A1 Oct. 29, 2009

Related U.S. Application Data

(60) Provisional application No. 61/047,504, filed on Apr. 24, 2008.

(51) Int. Cl.
*F02D 41/30* (2006.01)

(52) U.S. Cl. ..... 701/109; 123/672

(58) Field of Classification Search ..... 123/672, 123/673, 703; 701/103–105, 109; 73/114.69, 73/114.71, 114.72, 114.73; 60/274, 285–286
See application file for complete search history.

(56) References Cited

U.S. PATENT DOCUMENTS 7,246,004 B2 7/2007 Dudek

OTHER PUBLICATIONS

U.S. Appl. No. 11/954,892, filed Dec. 12, 2007, Frank Tornambe.

*Primary Examiner* — Hai H Huynh

(57) ABSTRACT

A fuel control system of an engine includes a simulation module and a control module. The simulation module generates a simulated pre-catalyst exhaust gas oxygen (EGO) sensor signal based on a simulated oxygen concentration of an exhaust gas. The simulation module determines a simulated pre-catalyst equivalence ratio (EQR) for the exhaust gas based on the simulated pre-catalyst EGO sensor signal. The control module generates a desired pre-catalyst EGO sensor signal based on a desired oxygen concentration of the exhaust gas. The control module determines a desired pre-catalyst EQR based on the desired pre-catalyst EGO sensor signal. The control module determines a cost function based on the simulated pre-catalyst EQR and the desired pre-catalyst EQR. The fuel control system is calibrated based on the cost function.

18 Claims, 7 Drawing Sheets

OFF-LINE CALIBRATION OF UNIVERSAL TRACKING AIR FUEL RATIO REGULATORS

CROSS-REFERENCE TO RELATED APPLICATIONS

This application claims the benefit of U.S. Provisional Application No. 61/047,504, filed on Apr. 24, 2008. The disclosure of the above application is incorporated herein by reference.

FIELD

The present disclosure relates to engine control systems, and more particularly to fuel control systems for internal combustion engines.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A fuel control system reduces emissions of a gasoline engine. The fuel control system controls an amount of fuel delivered to the engine based on data sensed by one or more exhaust gas oxygen (EGO) sensors disposed in an exhaust system of a vehicle. The EGO sensors are of two types: universal (wide-range) EGO sensors and switching-type EGO sensors. Typically, the term EGO sensor refers to a switching-type EGO sensor. As used herein, EGO sensors include wide-range EGO sensors and switching-type EGO sensors unless specified otherwise.

The fuel control system may include an inner feedback loop and an outer feedback loop. The inner feedback loop may use data from an exhaust gas oxygen (EGO) sensor arranged before a catalytic converter (i.e., a pre-catalyst EGO sensor) to control an amount of fuel delivered to the engine.

For example, when the pre-catalyst EGO sensor senses a rich air/fuel ratio in an exhaust gas (i.e., non-burnt fuel vapor), the inner feedback loop may decrease a desired amount of fuel sent to the engine (i.e., decrease a fuel command). When the pre-catalyst EGO sensor senses a lean air/fuel ratio in the exhaust gas (i.e., excess oxygen), the inner feedback loop may increase the fuel command. This maintains the air/fuel ratio at true stoichiometry, or an ideal air/fuel ratio, thereby improving the performance of the fuel control system. Improving the performance of the fuel control system may improve the fuel economy of the vehicle.

The inner feedback loop may use a proportional-integral control scheme to correct the fuel command. The fuel command may be further corrected based on a short term fuel trim or a long term fuel trim. The short term fuel trim may correct the fuel command by changing gains of the proportional-integral control scheme based on engine operating conditions. The long term fuel trim may correct the fuel command when the short term fuel trim is unable to fully correct the fuel command within a desired time period.

The outer feedback loop may use information from an EGO sensor arranged after the converter (i.e., a post-catalyst EGO sensor) to correct the EGO sensors and/or the converter when there is an unexpected reading. For example, the outer feedback loop may use the information from the post-catalyst EGO sensor to maintain the post-catalyst EGO sensor at a required voltage level. As such, the converter maintains a desired amount of oxygen stored, thereby improving the performance of the fuel control system. The outer feedback loop may control the inner feedback loop by changing thresholds used by the inner feedback loop to determine whether the air/fuel ratio is rich or lean.

Exhaust gas composition affects the behavior of the EGO sensors, thereby affecting accuracy of the EGO sensor values. As a result, fuel control systems have been designed to operate based on values that are different than those reported. For example, fuel control systems have been designed to operate "asymmetrically," where the threshold used to indicate the lean air/fuel ratio is different than the threshold used to indicate the rich air/fuel ratio.

Since the asymmetry is a function of the exhaust gas composition and the exhaust gas composition is a function of the engine operating conditions, the asymmetry is typically designed as a function of the engine operating conditions. The asymmetry is achieved indirectly by adjusting the gains and the thresholds of the inner feedback loop, which requires numerous tests at each of the engine operating conditions. Moreover, this extensive calibration is required for each powertrain and vehicle class and does not easily accommodate other technologies, including, but not limited to, variable valve timing and lift.

SUMMARY

A fuel control system of an engine includes a simulation module and a control module. The simulation module generates a simulated pre-catalyst exhaust gas oxygen (EGO) sensor signal based on a simulated oxygen concentration of an exhaust gas. The simulation module determines a simulated pre-catalyst equivalence ratio (EQR) for the exhaust gas based on the simulated pre-catalyst EGO sensor signal. The control module generates a desired pre-catalyst EGO sensor signal based on a desired oxygen concentration of the exhaust gas. The control module determines a desired pre-catalyst EQR based on the desired pre-catalyst EGO sensor signal. The control module determines a cost function based on the simulated pre-catalyst EQR and the desired pre-catalyst EQR. The fuel control system is calibrated based on the cost function.

A method for controlling fuel supply to an engine comprises generating a simulated pre-catalyst exhaust gas oxygen (EGO) sensor signal based on a simulated oxygen concentration of an exhaust gas and determining a simulated pre-catalyst equivalence ratio (EQR) for the exhaust gas based on the simulated pre-catalyst EGO sensor signal. The method further comprises generating a desired pre-catalyst EGO sensor signal based on a desired oxygen concentration of the exhaust gas and determining a desired pre-catalyst EQR for the exhaust gas based on the desired pre-catalyst EGO sensor signal. The method further comprises determining a cost function based on the simulated pre-catalyst EQR and the desired pre-catalyst EQR. The method further comprises calibrating the fuel control system based on the cost function.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
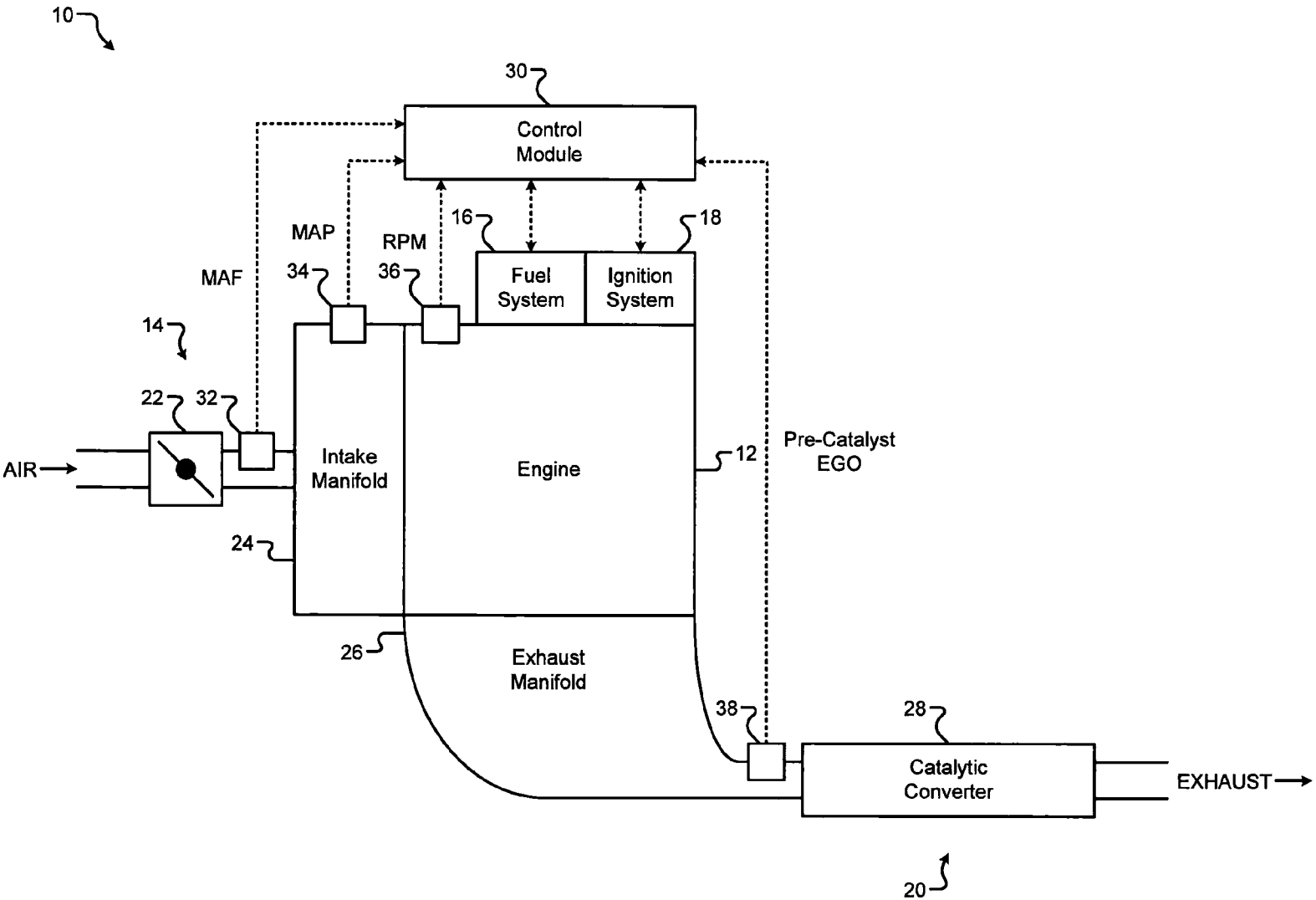
FIG. 1 is a functional block diagram of an exemplary implementation of an engine system according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

To reduce calibration costs associated with conventional fuel control systems, the fuel control system of the present disclosure allows for direct achievement of desired behavior, including asymmetric behavior. The fuel control system of the present disclosure achieves the desired behavior through open loop control instead of closed loop control. The open loop control may include using a model that relates the desired behavior to a fuel command or a dither signal needed to achieve the desired behavior instead of calibrating gains of the closed loop control.

Specifically, the fuel control system achieves the desired behavior of an oscillating oxygen concentration level of an exhaust gas through open loop control. Such oscillations improve the performance of the fuel control system. For example, the oscillations prevent a low or a high oxygen storage level in a catalytic converter of the engine system. The fuel control system achieves the oscillating oxygen concentration level by determining an expected oxygen concentration level of the exhaust gas based on a model that relates the expected level to the desired level. The fuel control system compensates a current fuel command to meet the expected oxygen concentration level even amidst system disturbances and/or modeling errors. The fuel control system accommodates different powertrains (e.g., powertrains with heated oxygen sensors and/or wide range sensors) and vehicle classes.

The present disclosure relates to systems and methods for calibrating the fuel control system. The systems and methods include running a simulation of the fuel control system to identify closed loop control gains based on vehicle test data, expected fuel disturbances, and disturbances to an engine simulation module. The systems and methods further include determining a cost function based on a desired equivalence ratio (EQR) of the exhaust gas and an actual EQR of the exhaust gas. The cost function is optimized via a genetic algorithm to calibrate the closed loop control gains at values that minimize the difference between the desired EQR and the actual EQR.

Referring now to FIG. 1, an exemplary engine system 10 is shown. The engine system 10 includes an engine 12, an intake system 14, a fuel system 16, an ignition system 18, and an exhaust system 20. The engine 12 may be any type of internal combustion engine with fuel injection. For example only, the engine 12 may include fuel injected engines, gasoline direct injection engines, homogeneous charge compression ignition engines, or other types of engines.

The intake system 14 includes a throttle 22 and an intake manifold 24. The throttle 22 controls air flow into the engine 12. The fuel system 16 controls fuel flow into the engine 12. The ignition system 18 ignites an air/fuel mixture provided to the engine 12 by the intake system 14 and the fuel system 16.

An exhaust gas created by combustion of the air/fuel mixture exits the engine 12 through the exhaust system 20. The exhaust system 20 includes an exhaust manifold 26 and a catalytic converter 28. The catalytic converter 28 receives the exhaust gas from the exhaust manifold 26 and reduces toxicity of the exhaust gas before it leaves the engine system 10.

The engine system 10 further includes a control module 30 that regulates operation of the engine 12 based on various engine operating parameters. The control module 30 is in communication with the fuel system 16 and the ignition system 18. The control module 30 is further in communication with a mass air flow (MAF) sensor 32, a manifold air pressure (MAP) sensor 34, and an engine revolutions per minute (RPM) sensor 36. The control module 30 is further in communication with an exhaust gas oxygen (EGO) sensor arranged in the exhaust manifold 26 (i.e., a pre-catalyst EGO sensor 38).

The MAF sensor 32 generates a MAF signal based on a mass of air flowing into the intake manifold 24. The MAP sensor 34 generates a MAP signal based on an air pressure in the intake manifold 24. The RPM sensor 36 generates a RPM signal based on a rotational velocity of a crankshaft (not shown) of the engine 12.

The pre-catalyst EGO sensor 38 generates a pre-catalyst EGO signal based on an oxygen concentration level of the exhaust gas in the exhaust manifold 26. For example only, the pre-catalyst EGO sensor 38 may include, but is not limited to, a switching EGO sensor or a universal EGO (UEGO) sensor. The switching EGO sensor generates an EGO signal in units of voltage and switches the EGO signal to a low or a high voltage when the oxygen concentration level is lean or rich, respectively. The UEGO sensor generates an EGO signal in units of equivalence ratio (EQR) and eliminates the switching between lean and rich oxygen concentration levels of the switching EGO sensor.

Figure 2:
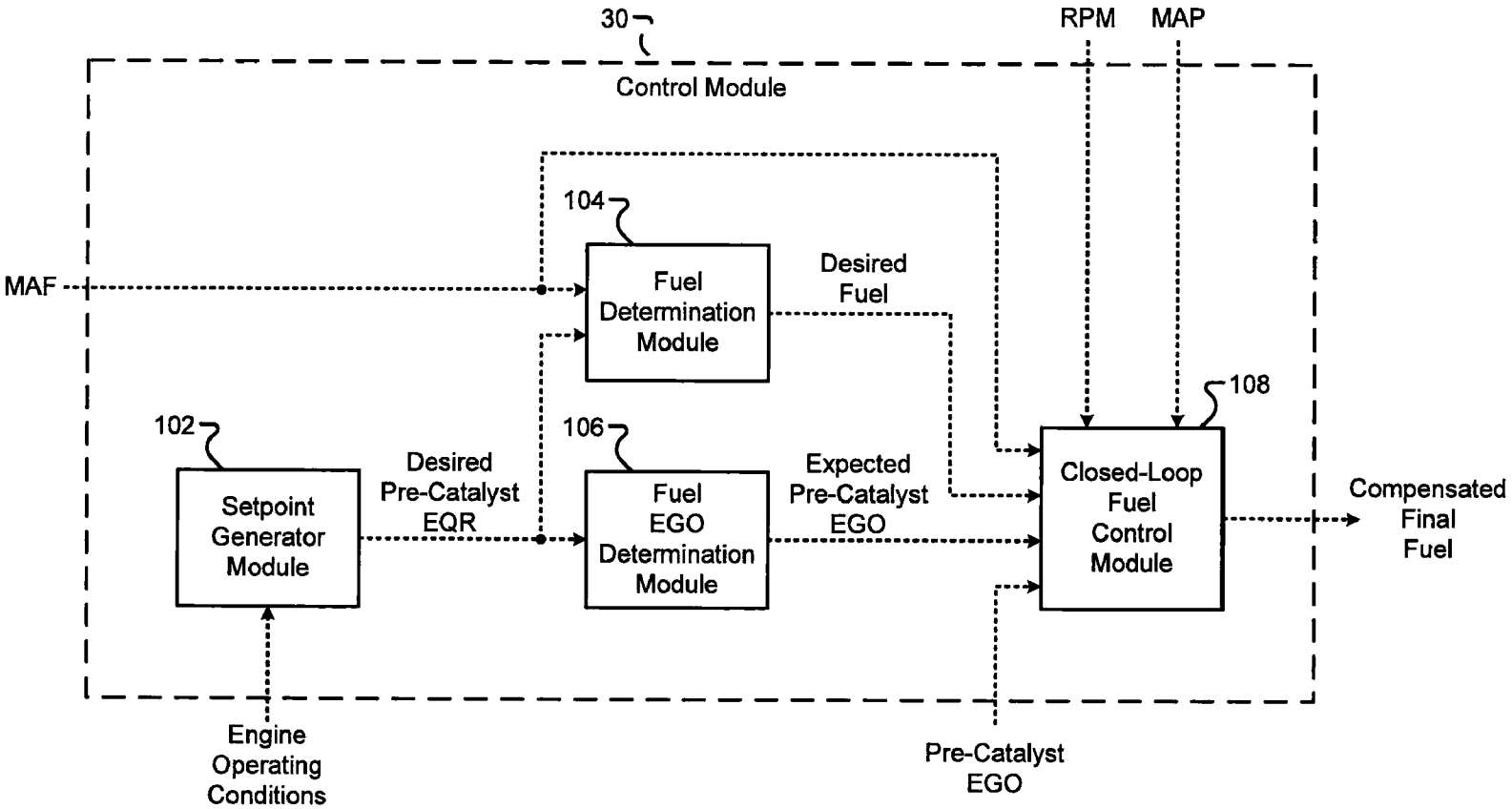
FIG. 2 is a functional block diagram of an exemplary implementation of a control module according to the present disclosure.

Referring now to FIG. 2, the control module 30 includes a setpoint generator module 102, a fuel determination module 104, a fuel EGO determination module 106, and a closed-loop fuel control module 108. The setpoint generator module 102 generates a desired pre-catalyst EQR signal based on a dither signal and a desired oxygen concentration level of the exhaust gas in the exhaust manifold 26.

The desired pre-catalyst EQR signal oscillates about the desired oxygen concentration level. The setpoint generator module 102 is an open loop command generator and determines the dither signal and the desired oxygen concentration level based on engine operating conditions. The engine operating conditions may include, but are not limited to, the rotational velocity of the crankshaft, the air pressure in the intake manifold 24, and/or a temperature of engine coolant.

The fuel determination module 104 receives the desired pre-catalyst EQR signal and the MAF signal. The fuel determination module 104 determines a desired fuel command based on the desired pre-catalyst EQR signal and the MAF signal. More specifically, the fuel determination module 104 multiplies the desired pre-catalyst EQR signal by the MAF signal.

The fuel determination module 104 further multiplies the product of the desired pre-catalyst EQR signal and the MAF signal by a predetermined air-fuel ratio at stoichiometry to determine the desired fuel command. For example only, the air-fuel ratio at stoichiometry may be 1:14.7. The desired fuel command oscillates due to the oscillations (due to dithering) of the desired pre-catalyst EQR signal.

The fuel EGO determination module 106 receives the desired pre-catalyst EQR signal and generates an expected pre-catalyst EGO signal based on the desired pre-catalyst EQR signal. The expected pre-catalyst EGO signal includes the expected oxygen concentration level of the exhaust gas in the exhaust manifold 26 in response to the desired fuel command. The closed-loop fuel control module 108 receives the MAF signal, the desired fuel command, the expected pre-catalyst EGO signal, the pre-catalyst EGO signal, the RPM signal, and the MAP signal.

The closed-loop fuel control module 108 determines a fuel correction factor based on the MAF signal, expected pre-catalyst EGO signal, the pre-catalyst EGO signal, the RPM signal, and the MAP signal. The fuel correction factor minimizes an error between the expected pre-catalyst EGO signal and the pre-catalyst EGO signal. The closed-loop fuel control module 108 adds the fuel correction factor to the desired fuel command to determine a new command for the fuel system 16 (i.e., a compensated final fuel command).

Figure 3:
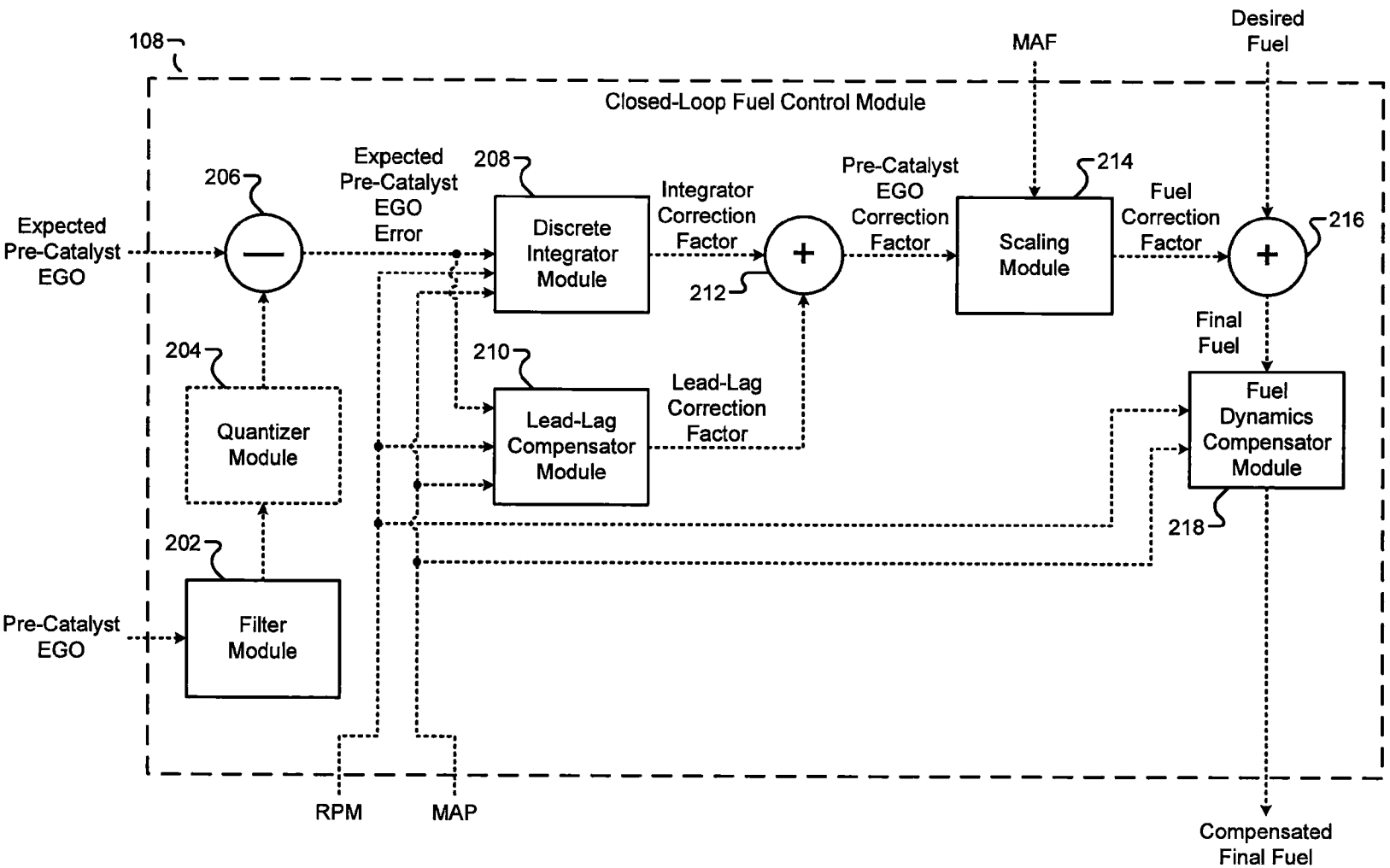
FIG. 3 is a functional block diagram of an exemplary implementation of a closed-loop fuel control module according to the present disclosure.

Referring now to FIG. 3, the closed-loop fuel control module 108 is shown. The closed-loop fuel control module 108 includes a filter module 202, a subtraction module 206, a discrete integrator module 208, a lead-lag compensator module 210, and a summation module 212. The closed-loop fuel control module 108 further includes a scaling module 214, a summation module 216, and a fuel dynamics compensator module 218. The closed-loop fuel control module 108 includes a quantizer module 204 if the pre-catalyst EGO sensor 38 includes a switching EGO sensor.

The filter module 202 receives the pre-catalyst EGO signal and filters the pre-catalyst EGO signal for use by the closed-loop fuel control module 108. For example only, the filter module 202 may include, but is not limited to, a first-order lag filter that reduces the noise of the pre-catalyst EGO signal. When the pre-catalyst EGO sensor 38 includes a switching EGO sensor, the first-order lag filter causes the pre-catalyst EGO signal to lag and to better indicate switching between lean and rich air/fuel ratios. If the pre-catalyst EGO sensor 38 includes a switching EGO sensor, the quantizer module 204 receives the pre-catalyst EGO signal. The quantizer module 204 quantizes (i.e., converts into a discrete and/or digital signal) the pre-catalyst EGO signal for use by the closed-loop fuel control module 108.

The subtraction module 206 receives the expected pre-catalyst EGO signal and the pre-catalyst EGO signal. The subtraction module 206 subtracts the pre-catalyst EGO signal from the expected pre-catalyst EGO signal to determine a expected pre-catalyst EGO error. The discrete integrator module 208 receives the expected pre-catalyst EGO error, the RPM signal, and the MAF signal.

The discrete integrator module 208 discretely integrates the expected pre-catalyst EGO error to determine an integrator correction factor. The discrete integrator module 208 uses a proportional-integral (PI) control scheme to determine the integrator correction factor. The integrator correction factor includes an offset based on a discrete integral of the difference between the expected pre-catalyst EGO signal and the pre-catalyst EGO signal.

The discrete integrator module 208 determines a gain of the integral correction factor based on the RPM signal and the MAF signal. The integrator correction factor is in units of equivalence ratio (EQR). The integrator correction factor is used to correct small expected pre-catalyst EGO errors and to handle slow variations in the expected pre-catalyst EGO signal and the pre-catalyst EGO signal.

The lead-lag compensator module 210 receives the expected pre-catalyst EGO error, the RPM signal, and the MAF signal. The lead-lag compensator module 210 discretely integrates the expected pre-catalyst EGO error to determine a lead-lag correction factor. The lead-lag compensator module 210 uses a PI control scheme to determine the lead-lag correction factor. The lead-lag compensator module 210 includes an offset based on a discrete integral of the difference between the expected pre-catalyst EGO signal and the pre-catalyst EGO signal.

The lead-lag compensator module 210 determines the gains of the lead-lag correction factor based on the RPM signal and the MAF signal. The lead-lag correction factor is in units of equivalence ratio (EQR). The lead-lag correction factor is used to correct large expected pre-catalyst EGO errors and to handle fast variations in the expected pre-catalyst EGO signal and the pre-catalyst EGO signal.

The summation module 212 receives the integrator correction factor and the lead-lag correction factor and sums the correction factors to determine a pre-catalyst EGO correction factor. The scaling module 214 receives the pre-catalyst EGO correction factor and the MAF signal. The scaling module 214 determines the fuel correction factor based on the pre-catalyst EGO correction factor and the MAF signal.

More specifically, the scaling module 214 multiplies the pre-catalyst EGO correction factor by the MAF signal. The scaling module 214 further multiplies the product of the pre-catalyst EGO correction factor and the MAF signal by the air-fuel ratio at stoichiometry to determine the fuel correction factor. The summation module 216 receives the fuel correction factor and the desired fuel command and sums the fuel correction factor and the desired fuel command to determine a final fuel command.

The fuel dynamics compensator module 218 receives the final fuel command, the RPM signal, and the MAP signal. The fuel dynamics compensator module 218 determines a compensated final fuel command based on the final fuel command, the RPM signal, and the MAP signal. The compensated final fuel command is the inverse of nominal fuel dynamics behavior of the engine 12 that is determined based on a nominal fuel command, the RPM signal, and the MAP signal. In addition, the compensated final fuel command may compensate the nominal fuel command for lost fuel in the engine system 10 (i.e., fuel injected into the engine 12 that is not burned in a combustion cycle). Further discussion of the compensated final fuel command may be found in commonly assigned U.S. Pat. No. 7,246,004, issued on Jul. 17, 2007 and entitled "Nonlinear Fuel Dynamics Control with Lost Fuel Compensation," the disclosure of which is incorporated herein by reference in its entirety.

Figure 4:
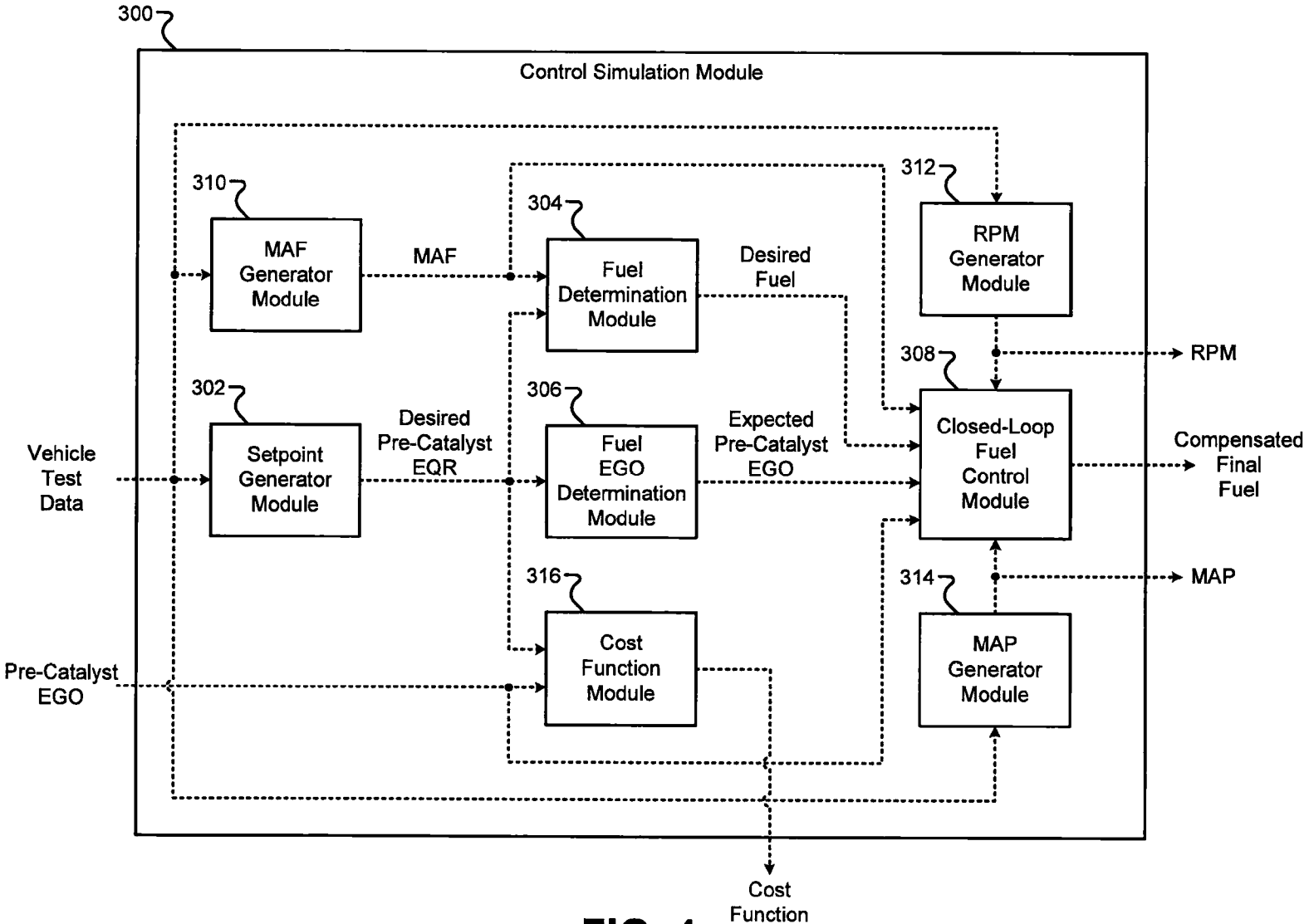
FIG. 4 is a functional block diagram of an exemplary implementation of a control simulation module according to the present disclosure.

Referring now to FIG. 4, a control simulation module 300 is shown. The control simulation module 300 includes a setpoint generator module 302, a fuel determination module 304, a fuel EGO determination module 306, and a closed-loop fuel control module 308. The control simulation module 300 further includes a MAF generator module 310, a RPM generator module 312, a MAP generator module 314, and a cost function module 316. The control simulation module 300 is used to exercise a simulation of the fuel control system at different gains of the closed-loop fuel control module 308. The control simulation module 300 is further used to determine a cost function based on the desired pre-catalyst EQR signal and the pre-catalyst EGO signal determined by the simulation.

The fuel determination module 304 includes the same functionality as the fuel determination module 104. The fuel EGO determination module 306 includes the same functionality as the fuel EGO determination module 106. The closed-loop fuel control module 308 includes the same functionality as the closed-loop fuel control module 108.

The setpoint generator module 302 receives vehicle test data and generates the desired pre-catalyst EQR signal based on the vehicle test data. For example only, the vehicle test data may be collected from a representative vehicle driven over various driving schedules. For example only, the driving schedules may include, but are not limited to, a Federal Test Procedure (FTP), a normal driving schedule, and a heavy transient driving schedule.

The MAF generator module 310 receives the vehicle test data and generates a MAF signal based on the vehicle test data for use by the control simulation module 300. The RPM generator module 312 receives the vehicle test data and generates a RPM signal based on the vehicle test data for use by the control simulation module 300. The MAP generator module 314 receives the vehicle test data and generates a MAP signal based on the vehicle test data for use by the control simulation module 300.

Figure 5:
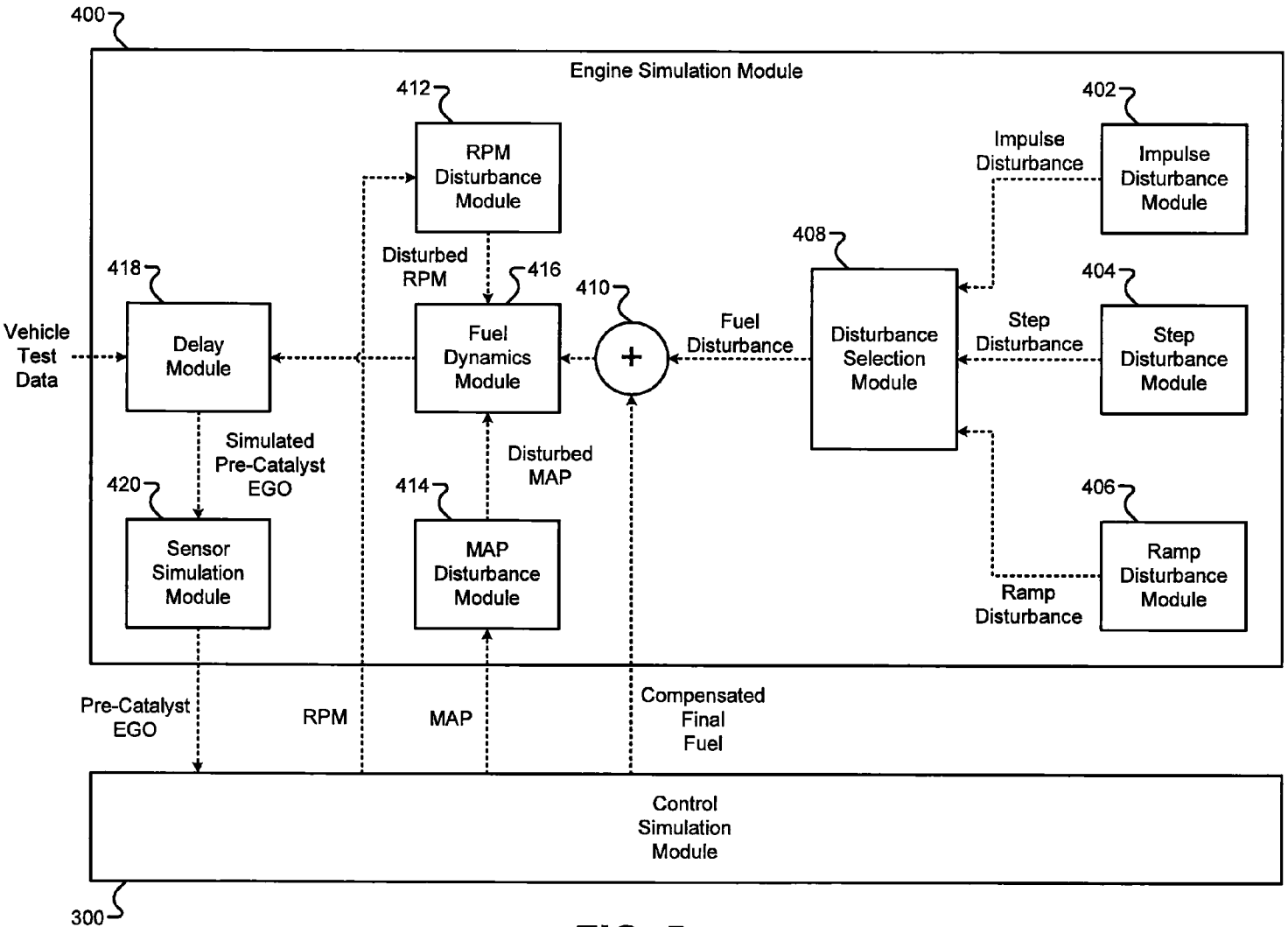
FIG. 5 is a functional block diagram of an exemplary implementation of an engine simulation module that is connected to the control simulation module according to the present disclosure.

The cost function module 316 receives the desired pre-catalyst EQR signal generated by the setpoint generator 302 and the pre-catalyst EGO signal generated by an engine simulation module of FIG. 5. The cost function module 316 determines a desired pre-catalyst EGO error based on the desired pre-catalyst EGO signal and the pre-catalyst EGO signal. The desired pre-catalyst EGO error is determined according to the following equation:

$$\text{error}(k)=(\text{EGO}(k)-\text{EGO}_{desired}(k))/\text{EGO}_{desired}(k), \tag{1}$$

where k is a number of events, EGO is the pre-catalyst EGO and $\text{EGO}_{desired}$ is the desired pre-catalyst EGO. For example only, an event may include, but is not limited to, each time the engine 12 ignites the air/fuel mixture (i.e., an engine firing event).

The cost function module 316 determines an average of desired pre-catalyst EGO errors for all events within each zone and a standard deviation of the desired pre-catalyst EGO error for all events within each zone. A zone is a range of events in which a spline of a function of an engine operating condition is within predetermined knots of the spline. Further discussion of the zone can be found in commonly assigned patent application Ser. No. 11/954,892, filed Dec. 12, 2007, and entitled "Calibration Systems and Methods for Scheduled Linear Control Algorithms in Internal Combustion Engine Control Systems Using Genetic Algorithms, Penalty Functions, Weighting, and Embedding," the disclosure of which is incorporated herein by reference in its entirety. An average desired pre-catalyst EGO error for a zone A is determined according to the following equation:

$$A_m(k)=\text{avg}(\text{error}(k))\forall k\epsilon\text{zone}_m \tag{2}$$

where $\text{zone}_m$ is a zone. A standard deviation of the desired pre-catalyst EGO error for a zone S is determined according to the following equation:

$$S_m(k)=\text{std}(\text{error}(k))\forall k\epsilon\text{zone}_m \tag{3}$$

The cost function module 316 determines a local cost function for each zone based on the average and the standard deviation of the desired pre-catalyst EGO error of each zone. A local cost function for a zone $C_m$ is determined according to the following equation:

$$C_m=\text{avg}(|A_m(k)|)+\text{avg}(|S_m(k)|). \tag{4}$$

The cost function module 316 determines a cost function for all zones based on the local cost function for each zone. A cost function for all zones C is determined according to the following equation:

$$C=\sum_{m=1}^{n} W_m\times C_m, \tag{5}$$

where n is the total number of zones and $W_m$ is a weighting function for a zone. Further discussion of the weighting function can be found in the aforesaid commonly assigned patent application.

To ensure stability of the closed-loop fuel control module 308, the cost function module 316 determines poles, or roots, of the closed loop system. A pole polynomial of the transfer function for the desired pre-catalyst EGO signal N(z) is determined according to the following equation:

$$N(z)=z^n-\alpha_1\times z^{n-1}-\alpha_2\times z^{n-2}-\ldots-\alpha_n \tag{6}$$

where $\alpha_i$ are constants that are determined based on the engine operating conditions at a single event. The cost function module 316 determines a maximum modulus of the poles of the pole polynomial for a zone $\text{pmax}_m$ according to the following equation:

$$p\max_m=\max_{k\in zone_m}(\|r\|)\text{s.t}\cdot N(r)=0. \tag{7}$$

The cost function module 316 determines a penalty function for each zone based on whether the maximum modulus of the poles in each zone is less than or equal to a predetermined value. If the maximum modulus of the poles in each zone is less than or equal to the predetermined value, the closed-loop fuel control module 308 is stable or mildly unstable in the zone, and the penalty function is set to zero. If the maximum modulus is greater than the predetermined value, the closed-loop fuel control module 308 is unstable in the zone, and the penalty function is determined based the maximum modulus and the predetermined value. For example only, the predetermined value may be set to, but is not limited to, 0.985. A penalty function for a zone $Cp^i_m$ is determined according to the following equation:

$$Cp^i_m = \begin{cases} 0 & \text{if } p\ \max_m \le \text{thresh} \\ e^{(p\ max_m - thresh)} - 1 & \text{otherwise} \end{cases}, \quad (8)$$

where thresh is the predetermined value.

The cost function module 316 may add the penalty function for each zone to the cost function for each zone to penalize unstable values of the closed-loop fuel control module 308. A cost function for all zones C may be determined according to the following equation:

$$C = \sum_{m=1}^{n} (C_m + Cp^i_m). \quad (9)$$

Further discussion of the stability penalty function can be found in the aforesaid commonly assigned patent application.

The cost function is output to a calibration module (not shown) that may be included in the control simulation module 300 or elsewhere. The calibration module calibrates the gains of the closed-loop fuel control module 108 with values that minimize the cost function via a genetic algorithm. Further discussion of the calibration of the gains of the closed-loop fuel control module 108 and the genetic algorithm can be found in the aforesaid commonly assigned patent application.

Referring now to FIG. 5, an engine simulation module 400 that is connected to the control simulation module 300 is shown. The engine simulation module 400 includes an impulse disturbance module 402, a step disturbance module 404, a ramp disturbance module 406, a disturbance selection module 408, and a summation module 410. The engine simulation module 400 further includes a RPM disturbance module 412, a MAP disturbance module 414, a fuel dynamics module 416, a delay module 418, and a sensor simulation module 420. The engine simulation module 400 is used to exercise the simulation of the fuel control system and the engine system 100.

The engine simulation module 400 introduces fuel disturbances to the compensated final fuel command to generate errors in the closed-loop fuel control module 108. The impulse disturbance module 402, the step disturbance module 404, and the ramp disturbance module 406 generate an impulse disturbance, a step disturbance, and a ramp disturbance, respectively. The disturbances are fuel disturbances that the fuel control system may experience and are randomly scaled as a percentage of the compensated final fuel command.

The disturbance selection module 408 receives the disturbances and randomly selects either none or one of the disturbances to determine a fuel disturbance. For example only, the disturbance selection module 408 may include, but is not limited to, a multiplexer or a switch. The summation module 410 receives the fuel disturbance and the compensated final fuel command from the control simulation module 300 and sums the fuel disturbance and the compensated final fuel command.

The RPM disturbance module 412 and the MAP disturbance module 414 receive the RPM signal and the MAP signal, respectively, from the control simulation module 300. The RPM disturbance module 412 filters and superimposes random noise onto the RPM signal to determine a disturbed RPM signal. The MAP disturbance module 414 filters and superimposes random noise onto the MAP signal to determine a disturbed MAP signal. For example only, the RPM disturbance module 412 and the MAP disturbance module 414 may each include, but are not limited, a low-pass filter. The disturbed RPM signal and the disturbed MAP signal are randomly scaled as a percentage of the amplitude of the RPM signal and a percentage of the amplitude of the MAP signal, respectively.

The fuel dynamics module 416 receives the sum of the compensated final fuel command and the fuel disturbance, the disturbed RPM signal, and the disturbed MAP signal. The fuel dynamics module 416 generates a simulated pre-catalyst EGO signal based on a simulated oxygen concentration level of the exhaust gas in the exhaust manifold 26. The fuel dynamics module 416 determines the simulated pre-catalyst EGO signal based on a model that relates the simulated pre-catalyst EGO signal to the nominal fuel dynamics behavior of the engine 12. The nominal fuel dynamics behavior is determined based on the sum of the compensated final fuel command and the fuel disturbance, the disturbed RPM signal, and the disturbed MAP signal.

The delay module 418 receives the simulated pre-catalyst EGO signal and the vehicle test data and determines a number of events to delay the simulated pre-catalyst EGO signal based on the vehicle test data. For example only, the number of events to delay the simulated pre-catalyst EGO signal may be determined to be a number of events from when the control simulation module 300 outputs the compensated final fuel command to when the sensor simulation module 420 determines the pre-catalyst EGO signal. The delay module 418 delays the simulated pre-catalyst EGO signal for the determined number of events.

The sensor simulation module 420 receives the simulated pre-catalyst EGO signal and determines the pre-catalyst EGO signal. The sensor simulation module 420 determines the pre-catalyst EGO signal based on a model that relates the pre-catalyst EGO signal to the simulated pre-catalyst EGO signal. The sensor simulation module 420 outputs the pre-catalyst EGO signal to the control simulation module 300.

Accordingly, the sensor simulation module 420 simulates the pre-catalyst EGO sensor 38. The pre-catalyst EGO signal differs from the expected pre-catalyst EGO signal since the fuel dynamics compensator module 218 determines the compensated final fuel command based on the RPM and the MAP signals instead of the disturbed RPM and the disturbed MAP signals. By injecting errors in the closed-loop fuel control module 108, the engine simulation module 400 allows the genetic algorithm to calibrate the closed loop control gains with values that are robust with respect to system disturbances.

Figure 6:
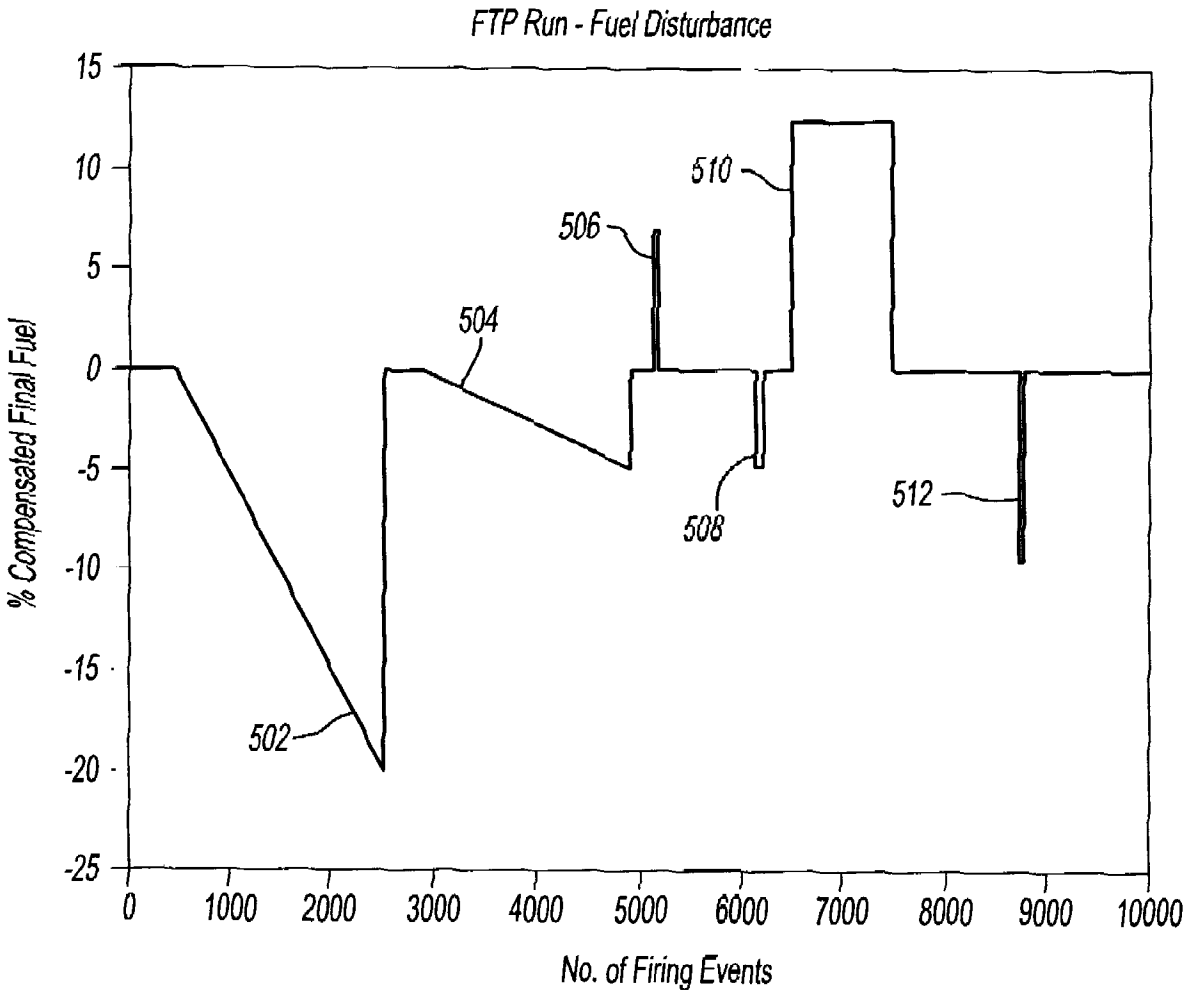
FIG. 6 is a an exemplary graph of a fuel disturbance as a function of a number of engine firing events according to the present disclosure.

Referring now to FIG. 6, an exemplary graph of a fuel disturbance as a function of a number of engine firing events is shown. The fuel disturbance is randomly scaled as a percentage of the compensated final fuel command that is determined based on vehicle test data. The vehicle test data is collected from a representative vehicle driven over the FTP (i.e., FTP run).

A ramp disturbance 502 is shown in which the fuel disturbance gradually decreases up to 20 percent of the compensated final fuel command for 2000 engine firing events. A ramp disturbance 504 is shown in which the fuel disturbance gradually decreases up to 5 percent of the compensated final fuel command for 2000 engine firing events. An impulse disturbance 506 is shown in which the fuel disturbance increases approximately 7.5 percent of the compensated final fuel command for one engine firing event.

An impulse disturbance 508 is shown in which the fuel disturbance decreases approximately 5 percent of the compensated final fuel command for one engine firing event. A step disturbance 510 is shown in which the fuel disturbance increases 12.5 percent of the compensated final fuel command for 1000 engine firing events. An impulse disturbance 512 is shown in which the fuel disturbance decreases approximately 10 percent of the compensated final fuel command for one engine firing event.

Figure 7:
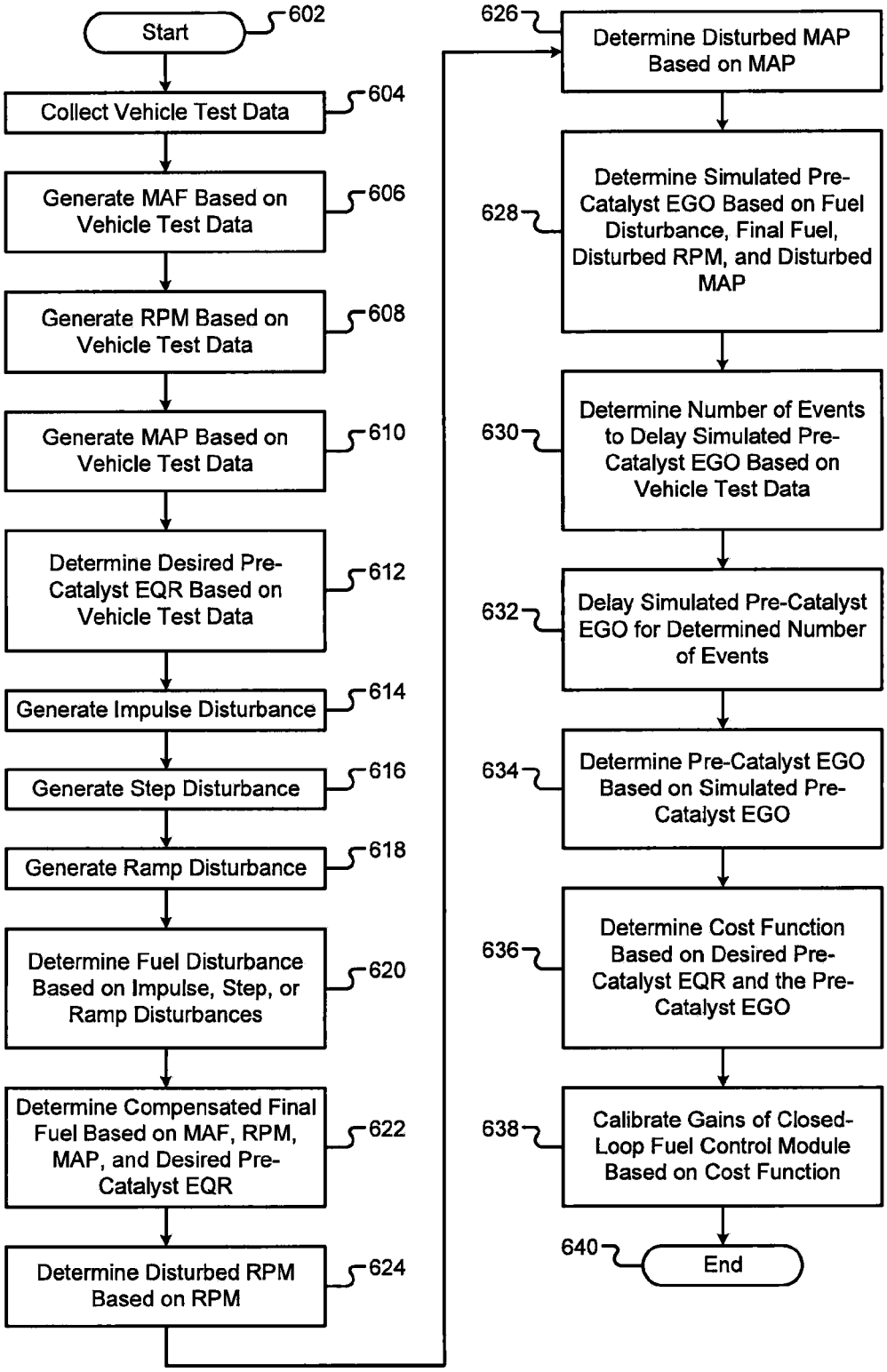
FIG. 7 is a flowchart depicting exemplary steps of a method for calibrating the closed-loop fuel control module according to the present disclosure.

Referring now to FIG. 7, a flowchart of exemplary steps of a method for calibrating the closed-loop fuel control module 108 is shown. The method begins in step 602. In step 604, the vehicle test data is collected. In step 606, the MAF signal (i.e., MAF) is generated based on the vehicle test data. In step 608, the RPM signal (i.e., RPM) is generated based on the vehicle test data. In step 610, the MAP signal (i.e., MAP) is generated based on the vehicle test data. In step 612, the desired pre-catalyst EQR signal (i.e., Desired Pre-Catalyst EQR) is generated based on the vehicle test data.

In step 614, the impulse disturbance is generated. In step 616, the step disturbance is generated. In step 618, the ramp disturbance is generated. In step 620, the fuel disturbance is determined based on the impulse, step, or ramp disturbances. In step 622, the compensated final fuel command is determined based on the MAF signal, the RPM signal, the MAP signal, and the desired pre-catalyst EQR signal. In step 624, the disturbed RPM signal (i.e., Disturbed RPM) is generated based on the RPM signal. In step 626, the disturbed MAP signal (i.e., Disturbed MAP) is generated based on the MAP signal. In step 628, the simulated pre-catalyst EGO signal (i.e., Simulated Pre-Catalyst EGO) is generated based on the fuel disturbance, the compensated final fuel command, the disturbed RPM signal, and the disturbed MAP signal.

In step 630, the number of events to delay the simulated pre-catalyst EGO signal is determined based on the vehicle test data. In step 632, the simulated pre-catalyst EGO signal is delayed for the determined number of events. In step 634, the pre-catalyst EQR signal (i.e., Pre-Catalyst EQR Signal) is generated based on the simulated pre-catalyst EGO signal. In step 636, the cost function for all the zones (i.e., Cost Function) is determined based on the desired pre-catalyst EQR signal and the pre-catalyst EGO signal. In step 638, the gains of the closed-loop fuel control module 108 are calibrated on the cost function for all the zones. Control ends in step 640.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification and the following claims.

What is claimed is:

1. A fuel control system of an engine, comprising:

a simulation module that generates a simulated pre-catalyst exhaust gas oxygen (EGO) sensor signal based on a simulated oxygen concentration of an exhaust gas and that determines a simulated pre-catalyst equivalence ratio (EQR) for the exhaust gas based on the simulated pre-catalyst EGO sensor signal; and a control module that generates a desired pre-catalyst EGO sensor signal based on a desired oxygen concentration of the exhaust gas, that determines a desired pre-catalyst EQR based on the desired pre-catalyst EGO sensor signal, and that determines a cost function based on the simulated pre-catalyst EQR and the desired pre-catalyst EQR, wherein the fuel control system is calibrated based on the cost function.

2. The simulation system of claim 1 wherein the simulation module determines the simulated pre-catalyst EQR based on a fuel disturbance of the fuel control system.

3. The simulation system of claim 2 wherein the fuel disturbance includes one of an impulse fuel disturbance, a step fuel disturbance, and a ramp fuel disturbance.

4. The simulation system of claim 1 wherein the simulation module determines the simulated pre-catalyst EQR based on the desired pre-catalyst EQR, a mass air flow (MAF), a manifold air pressure (MAP), and an engine revolutions per minute (RPM).

5. The simulation system of claim 4 wherein the control module determines the MAF, the MAP, and the engine RPM based on vehicle test data collected from a vehicle driven over a driving schedule.

6. The simulation system of claim 1 wherein the simulation module injects disturbances in revolutions per minute (RPM) and engine manifold air pressure (MAP) of an engine and determines the simulated pre-catalyst EQR based on the disturbances.

7. The simulation system of claim 1 wherein the simulation module determines a number of events to delay the simulated pre-catalyst EQR based on vehicle test data collected from a vehicle driven over a driving schedule and delays the simulated pre-catalyst EQR for the determined number of events.

8. The simulation system of claim 1 wherein the control module determines a penalty function based on the desired pre-catalyst EQR, and wherein the control module determines the cost function based on the penalty function.

9. The simulation system of claim 1 wherein the fuel control system is calibrated based on a genetic algorithm that minimizes the cost function.

10. A method for controlling fuel supply to an engine, comprising:

generating a simulated pre-catalyst exhaust gas oxygen (EGO) sensor signal based on a simulated oxygen concentration of an exhaust gas;

determining a simulated pre-catalyst equivalence ratio (EQR) for the exhaust gas based on the simulated pre-catalyst EGO sensor signal;

generating a desired pre-catalyst EGO sensor signal based on a desired oxygen concentration of the exhaust gas;

determining a desired pre-catalyst EQR for the exhaust gas based on the desired pre-catalyst EGO sensor signal;

determining a cost function based on the simulated pre-catalyst EQR and the desired pre-catalyst EQR; and calibrating the fuel control system based on the cost function.

11. The method of claim 10 further comprising determining the simulated pre-catalyst EQR based on a fuel disturbance of the fuel control system.

12. The method of claim 11 further comprising generating the fuel disturbance based on one of an impulse fuel disturbance, a step fuel disturbance, and a ramp fuel disturbance.

13. The method of claim 10 further comprising determining the simulated pre-catalyst EQR based on the desired pre-catalyst EQR, a mass air flow (MAF), a manifold air pressure (MAP), and an engine revolutions per minute (RPM).

14. The method m of claim 13 further comprising determining the MAF, the MAP, and the engine RPM based on vehicle test data collected from a vehicle driven over a driving schedule.

15. The method of claim 10 further comprising:

injecting disturbances in revolutions per minute (RPM) and engine manifold air pressure (MAP) of an engine; and determining the simulated pre-catalyst EQR based on the disturbances.

16. The method of claim 10 further comprising:

determining a number of events to delay the simulated pre-catalyst EQR based on vehicle test data collected from a vehicle driven over a driving schedule; and delaying the simulated pre-catalyst EQR for the determined number of events.

17. The method of claim 10 further comprising:

determining a penalty function based on the desired pre-catalyst EQR; and determining the cost function based on the penalty function.

18. The method of claim 10 further comprising calibrating the fuel control system based on a genetic algorithm that minimizes the cost function.

* * * * *